US007485399B2

(12) United States Patent
Lin et al.

(10) Patent No.: US 7,485,399 B2
(45) Date of Patent: Feb. 3, 2009

(54) IMAGING MEMBERS HAVING UNDERCOAT LAYER WITH A POLYMER RESIN AND NEAR INFRARED ABSORBING COMPONENT

(75) Inventors: Liang-Bih Lin, Rochester, NY (US); Daniel Vernon Levy, Rochester, NY (US); Jin Wu, Webster, NY (US); Francisco Jose Lopez, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 322 days.

(21) Appl. No.: 11/346,462

(22) Filed: Feb. 2, 2006

(65) Prior Publication Data

US 2007/0178395 A1 Aug. 2, 2007

(51) Int. Cl.
*G03G 5/14* (2006.01)

(52) U.S. Cl. ..... 430/60; 399/159

(58) Field of Classification Search ..... 430/60, 430/64, 65; 399/159
See application file for complete search history.

(56) References Cited

U.S. PATENT DOCUMENTS

| | | | | | |
|---|---|---|---|---|---|
| 4,265,990 | A | | 5/1981 | Stolka et al. | 430/58.8 |
| 4,419,427 | A | | 12/1983 | Graser et al. | 430/58.6 |
| 4,429,029 | A | | 1/1984 | Hoffmann et al. | 430/58.6 |
| 4,501,906 | A | | 2/1985 | Spietschka | 549/232 |
| 4,555,463 | A | | 11/1985 | Hor | 430/57.3 |
| 4,587,189 | A | | 5/1986 | Hor et al. | 430/58.8 |
| 4,709,029 | A | | 11/1987 | Spietschka | 544/125 |
| 4,714,666 | A | | 12/1987 | Wiedemann et al. | 430/59.1 |
| 4,937,164 | A | | 6/1990 | Duff et al. | 430/58.8 |
| 4,968,571 | A | | 11/1990 | Gruenbaum et al. | 430/59.1 |
| 5,019,473 | A | | 5/1991 | Nguyen et al. | 430/59.1 |
| 5,028,504 | A | * | 7/1991 | Rule et al. | 430/59.1 |
| 5,055,366 | A | | 10/1991 | Yu et al. | 430/58.8 |
| 5,225,307 | A | | 7/1993 | Hor et al. | 430/136 |
| 5,336,577 | A | | 8/1994 | Spiewak et al. | 430/58.25 |
| 5,403,686 | A | * | 4/1995 | Bugner et al. | 430/59.1 |
| 5,471,313 | A | | 11/1995 | Thieret et al. | 358/296 |
| 5,473,064 | A | | 12/1995 | Mayo et al. | 540/141 |
| 5,645,965 | A | | 7/1997 | Duff et al. | 430/58.8 |
| 5,756,245 | A | | 5/1998 | Esteghamatian et al. | 430/58.8 |
| 5,797,064 | A | | 8/1998 | Raj et al. | 399/46 |
| 5,891,594 | A | | 4/1999 | Yuh et al. | 430/71 |
| 5,958,638 | A | | 9/1999 | Katayama et al. | 430/65 |
| 6,051,351 | A | | 4/2000 | Hsiao et al. | 430/59.1 |
| 6,074,791 | A | | 6/2000 | Jennings et al. | 430/58.8 |
| 6,136,521 | A | * | 10/2000 | Hikosaka et al. | 430/61 |
| 6,165,660 | A | | 12/2000 | Chambers et al. | 430/56 |
| 6,183,921 | B1 | | 2/2001 | Yu et al. | 430/58.7 |
| 6,194,110 | B1 | | 2/2001 | Hsiao et al. | 430/58.7 |
| 6,656,651 | B1 | | 12/2003 | Bender et al. | 430/58.8 |
| 6,824,938 | B2 | | 11/2004 | Kizaki et al. | 430/60 |
| 2007/0092816 | A1 | * | 4/2007 | Wu et al. | 430/65 |

OTHER PUBLICATIONS

Borsenberger, Paul M. et al. Organic Photoreceptors for Imaging Systems. New York: Marcel-Dekker, Inc. (1993) pp. 6-17.*

Borsenberger, Paul M. et al. Organic Photoreceptors for Imaging Systems. New York: Marcel-Dekker, Inc. (1993) pp. 289-296.*

U.S. Appl. No. 10/758,046, filed Jan. 16, 2004, of John S. Chambers et al., entitled "Thick Intermediate and Undercoating Layers for Electrophotographic Imaging Members and Method for Making the Same," 17 pages, published Jul. 21, 2005.

U.S. Appl. No. 11/133,979, filed May 20, 2005, of Jin Wu et al., entitled "Imaging Member," 43 pages, not yet published.

* cited by examiner

*Primary Examiner*—Christopher RoDee
(74) *Attorney, Agent, or Firm*—Marylou J. Lavoie, Esq. LLC

(57) ABSTRACT

An imaging member including a metal or metallized substrate; an undercoat layer comprising a polymer resin and a near infrared absorbing component that absorbs at an imaging member exposure wavelength and has a high molar extinction coefficient; and one or more additional layers disposed on the undercoat layer, wherein the additional layer or layers comprise a charge-generating component and a charge-transport component.

18 Claims, No Drawings

IMAGING MEMBERS HAVING UNDERCOAT LAYER WITH A POLYMER RESIN AND NEAR INFRARED ABSORBING COMPONENT

BACKGROUND

The present disclosure relates generally to imaging members for electrophotography. Specifically, the disclosure teaches imaging members having a substrate, which can be a metal or metallized substrate in embodiments. In embodiments, the disclosure relates to imaging members having an undercoat layer having a polymer resin and a near infrared absorbing component that absorbs at an imaging member exposure wavelength and has a high molar extinction coefficient. In embodiments, the component is soluble in an undercoat layer solvent. In additional embodiments, one or more additional layers are disposed on the undercoat layer, and the additional layer or layers may include a charge-generating component and a charge-transport component.

In electrophotography, an electrophotographic substrate containing a photoconductive insulating layer on a conductive layer is imaged by first uniformly electrostatically charging a surface of the substrate. The substrate is then exposed to a pattern of activating electromagnetic radiation, such as, for example, light. The light or other electromagnetic radiation selectively dissipates the charge in illuminated areas of the photoconductive insulating layer while leaving behind an electrostatic latent image in non-illuminated areas of the photoconductive insulating layer. This electrostatic latent image is then developed to form a visible image by depositing finely divided electroscopic marking particles on the surface of the photoconductive insulating layer. The resulting visible image is then transferred from the electrophotographic substrate to a member, such as, for example, an intermediate transfer member or a print substrate, such as paper. This image developing process can be repeated as many times as necessary with reusable photoconductive insulating layers.

In electrophotography, an electrophotographic substrate containing a photoconductive insulating layer on a conductive layer is imaged by first uniformly electrostatically charging a surface of the substrate. The substrate is then exposed to a pattern of activating electromagnetic radiation, such as, for example, light. The light or other electromagnetic radiation selectively dissipates the charge in illuminated areas of the photoconductive insulating layer while leaving behind an electrostatic latent image in non-illuminated areas of the photoconductive insulating layer. This electrostatic latent image is then developed to form a visible image by depositing finely divided electroscopic marking particles on the surface of the photoconductive insulating layer. The resulting visible image is then transferred from the electrophotographic substrate to a member, such as, for example, an intermediate transfer member or a print substrate, such as paper. This image developing process can be repeated as many times as necessary with reusable photoconductive insulating layers.

Electrophotographic imaging members (i.e. photoreceptors) are well known. Electrophotographic imaging members are commonly used in electrophotographic (xerographic) processes having either a flexible belt or a rigid drum configuration. These electrophotographic imaging members sometimes comprise a photoconductive layer including a single layer or composite layers. These electrophotographic imaging members take many different forms. For example, layered photoresponsive imaging members are known in the art. U.S. Pat. No. 4,265,990, which is totally incorporated by reference herein, describes a layered photoreceptor having separate photogenerating and charge transport layers.

Photoconductive photoreceptors containing highly specialized component layers are also known. For example, a multilayered photoreceptor employed in electrophotographic imaging systems sometimes includes one or more of a substrate, an undercoating layer, an intermediate layer, an optional hole or charge blocking layer, a charge generating layer (including a photogenerating material in a binder) over an undercoating layer and/or a blocking layer, and a charge transport layer (including a charge transport material in a binder). Additional layers such as one or more overcoat layers are also sometimes included.

Photoconductive or photoresponsive imaging members are disclosed in the following U.S. Patents and U.S. Patent Applications, the disclosures of each of which are totally incorporated by reference herein, U.S. Pat. Nos. 4,265,990, 4,419,427, 4,429,029, 4,501,906, 4,555,463, 4,587,189, 4,709,029, 4,714,666, 4,937,164, 4,968,571, 5,019,473, 5,225,307, 5,336,577, 5,471,313, 5,473,064, 5,958,638, 5,645,965, 5,756,245, 5,797,064, 5,891,594, 6,051,351, 6,074,791, 6,194,110, 6,656,651, commonly assigned, co-pending U.S. Patent Application of John S. Chambers et al., Ser. No. 10/758,046, filed Jan. 16, 2004, entitled "Thick Intermediate and Undercoating Layers for Electrophotographic Imaging Members and Method for Making the Same" and commonly assigned, co-pending U.S. Patent Application of Jin Wu et al., Ser. No. 11/133,979, filed May 20, 2005, entitled "Imaging Member". The appropriate components and process aspects of the each of the foregoing U.S. Patents may be selected for the present disclosure in embodiments thereof.

Current issues in xerography include the occurrence of ghost image effects on printed substrates. For example, known photoconductors are believed to be susceptible to carrier injection from the substrate into the photosensitive layer such that the charge on the surface of the photoconductor may be microscopically dissipated or decayed. This often results in production of a defective image. Another problem relates to the phenomenon referred to as transfer ghost, which is a transfer current induced ghosting defect on an image believed to be caused by internal charge migration and/or charge injection from the top surface or substrate.

SUMMARY

Embodiments disclosed herein include an imaging member comprising a metal or metallized substrate; an undercoat layer comprising a polymer resin and a near infrared absorbing component that absorbs at an imaging member exposure wavelength and has a high molar extinction coefficient; and one or more additional layers disposed on the undercoat layer, wherein the additional layer or layers comprise a charge-generating component and a charge-transport component. In embodiments, the component is soluble in an undercoat layer solvent. In further embodiments, the dye can be insoluble or partially soluble and dispersed or otherwise disposed throughout the undercoat layer.

In embodiments, an imaging member is disclosed comprising a metal or metallized substrate; an undercoat layer comprising a polymer resin and a near infrared absorbing dye that absorbs at an imaging member exposure wavelength of from about 750 to about 900 nanometers, has a molar extinction coefficient of from about $10^3$ to about $5\times10^6$ and is soluble in an undercoat layer solvent; and one or more additional layers disposed on the undercoat layer, wherein the additional layer or layers comprise a charge-generating component and a charge-transport component.

Embodiments disclosed herein further include an image forming apparatus for forming images on a recording medium comprising a) a photoreceptor member having a charge retentive surface to receive an electrostatic latent image thereon, wherein said photoreceptor member comprises a conductive substrate, an undercoat layer comprising a polymer resin and a near infrared region absorbing component having a high molar extinction coefficient, wherein the near infrared absorbing component is soluble in an undercoat layer solvent, a charge-generating layer, and a charge transport layer comprising charge transport materials dispersed therein; b) a development component to apply a developer material to said charge-retentive surface to develop said electrostatic latent image to form a developed image on said charge-retentive surface; c) a transfer component for transferring said developed image from said charge-retentive surface to another member or a copy substrate; and d) a fusing member to fuse said developed image to said copy substrate.

DETAILED DESCRIPTION

In various exemplary embodiments of an electrophotographic imaging member as disclosed herein, an imaging member includes a metal or metallized substrate; an undercoat layer comprising a polymer resin and a near infrared absorbing component that absorbs at an imaging member exposure wavelength and, in embodiments, has a high molar extinction coefficient, wherein in embodiments the component is soluble in an undercoat layer solvent; and one or more additional layers disposed on the undercoat layer, wherein the additional layer or layers comprise a charge-generating component and a charge-transport component. The member may optionally include other layers, such as an adhesive layer. In various exemplary embodiments, additional layers are present and are located between a substrate layer and a photoconductive or photosensitive layer.

Also disclosed herein is an image forming apparatus for forming images on a recording medium comprising a) a photoreceptor member having a charge retentive surface to receive an electrostatic latent image thereon, wherein said photoreceptor member comprises a conductive substrate, an undercoat layer comprising a polymer resin and a near infrared region absorbing component having a high molar extinction coefficient, wherein the near infrared absorbing component is soluble in an undercoat layer solvent, a charge-generating layer, and a charge transport layer comprising charge transport materials dispersed therein; b) a development component to apply a developer material to said charge-retentive surface to develop said electrostatic latent image to form a developed image on said charge-retentive surface; c) a transfer component for transferring said developed image from said charge-retentive surface to another member or a copy substrate; and d) a fusing member to fuse said developed image to said copy substrate.

In embodiments, an undercoat layer is selected to include at least one material selected from resin material, such as polyethylene, polypropylene, polystyrene, acrylic resin, vinyl chloride resin, vinyl acetate resin, polyurethane, epoxy resin, polyester, melamine resin, silicone resin, polyvinyl butyryl, polyamide, phenolic resin, copolymers thereof, mixtures thereof, and copolymers containing two or more of repeated units of these resins. Such resin materials also include casein, gelatin, polyvinyl alcohol, ethyl cellulose, mixtures thereof, etc. Undercoat layers herein can be formed by any suitable method as known in the art. Undercoat layers are typically formed, for example, by a dip coating process, such as the methods disclosed in, for example, U.S. Pat. Nos. 5,958,638 and 5,891,594, the disclosures of each of which are totally incorporated by reference herein. In embodiments, the undercoat layer comprises a polymer resin and titanium dioxide. In a selected embodiment, the undercoat layer comprises a titanium dioxide, for example a titanium dioxide in a phenolic resin/melamine resin.

In embodiments, the undercoat layer comprises a thickness selected from about 0.1 to about 100 micrometers, from about 5 to about 20 micrometers, or a thickness of about 5 micrometers. However, thicknesses outside these ranges can be used, as desired.

Without wishing to be bound by theory, it is believed that various exemplary embodiments disclosed herein reduce or eliminate ghost image defects on a printed image by removing trapped electrons and holes residing in the imaging members. In embodiments disclosed herein, without wishing to be bound by theory, by providing an undercoat layer including a near infrared absorbing component, trapped electrons residing predominantly at or near the interface between the charge generating layer and the undercoat layer and holes residing predominantly at or near the interface between the charge generating layer and the charger transport layer are neutralized by free counter charges and dissipated to the top surface or substrate.

In various exemplary embodiments, the near infrared absorbing component has a strong absorption in a light wavelength range that matches an exposure wavelength used in the imaging process, such as in the exposure wavelength range of about 750 nanometers to about 900 nanometers. For example, selected near infrared absorbing components include hear infrared dyes that absorb strongly around 780 nanometers, the most common light exposure wavelength for xerography due to commercially available $Ga_{1-x}Al_xA_s$ diode lasers.

Embodiments disclosed herein include an undercoat layer comprising a near infrared absorbing component which absorbs at an exposure wavelength of about 750 to about 900 nanometers, about 750 to about 800 nanometers, or about 780 nanometers. Any suitable near infrared absorbing components may be included in the undercoat layer of various exemplary embodiments. Such near infrared absorbing components include, but are not limited to, for example, near infrared dyes which absorb at about 750 to about 900 nanometers, about 750 to about 800 nanometers, or about 780 nanometers.

In embodiments, the near infrared absorbing component selected for the undercoat layer has a molar extinction coefficient of about $10^3$ to about $5\times10^6$. In another selected embodiment, the near infrared absorbing component selected for the undercoat layer has a molar extinction coefficient of greater than about 100,000 or greater than about 200,000.

The near infrared absorbing component is selected in embodiments at an amount of about 0.01 to about 20% by weight, or about 0.02 to about 10% by weight. or about 0.1 to about 5% by weight, or about 2% by weight, based upon the total weight of the undercoat layer.

Suitable dyes include in embodiments dyes that are dissolvable in the solvent system of the undercoat layer, for example, typical undercoat layer solvents including, but not limited to, xylene, butanol, ketones, alcohols, halogenated solvents, and the like.

In embodiments, the near infrared dyes selected include, but are not limited to, for example, squaraines, aryldienes, aryltrienes, and metal dithiolene.

In further embodiments, the near infrared absorbing component includes a material commercially available from Crystalyn Chemical Company, having the following structure (1)

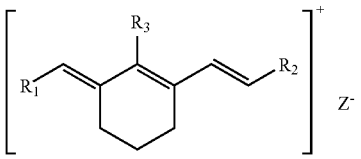

wherein $R_1$, $R_2$, and $R_3$ can in embodiments be the same or different and can be selected separately from about hydrocarbon having from about 1 to about 30 carbons, for example alky, alkenyl, alkynyl, aryl, heterocyclic substituents, etc., for example, in embodiments $R_1$ is selected as

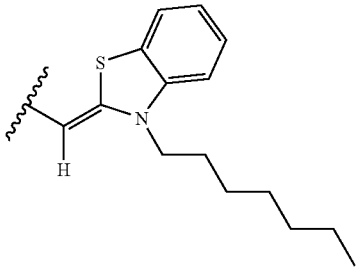

$R_2$ is selected as

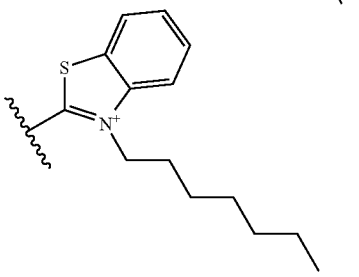

$R_3$ is selected from

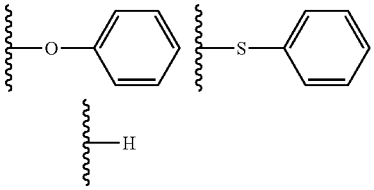

and

Z is selected from

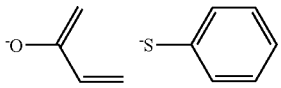

and $X^-$ wherein $X^-$ is selected for example, from the group consisting of Br, Cl, $ClO_4$, $BF_4$.

In embodiments, the near infrared absorbing component is, for example, 3-ethylidene-1-(ethenyl)cyclohexene.

In various exemplary embodiments, photoreceptors incorporating at least one undercoat layer doped with at least one near infrared absorbing component show excellent electrical properties with low dark decay, low voltage residue, and high photosensitivity.

The structure of a photoconductive member according to various exemplary embodiments disclosed herein can follow any of various known photoreceptor designs, modified to include herein-described various exemplary embodiments of undercoat or other layers. Because photoreceptor designs are well known in the art, the remaining layers of the imaging member, for example, photoreceptor will be described only in brief detail for completeness.

In various exemplary embodiments, an imaging member comprises a supporting substrate, an undercoating layer, a photogenerating layer and a charge transport layer (which can be separate or combined into a single photoconductor layer).

Optionally, an overcoat layer is added to improve resistance to abrasion. Further, a back coating can be selected and applied to the side opposite the imaging side of the photoreceptor to provide flatness and/or abrasion resistance. These overcoat and back coat layers can include any suitable composition, such as, for example, organic polymers or inorganic polymers that are electrically insulating or slightly semiconductive.

In various exemplary embodiments, a photoconductive imaging member as disclosed herein includes a supporting substrate, an undercoat layer, an adhesive layer, a photogenerating layer and a charge transport layer. These and other exemplary photoreceptor designs, which can be applied in embodiments of the disclosure, are described in, for example, U.S. Pat. Nos. 6,165,660, 3,357,989, 5,891,594, and 3,442,781, the entire disclosures of which are incorporated herein by reference.

The supporting substrate can be selected to include a conductive metal substrate or a metallized substrate. While a metal substrate is substantially or completely metal, the substrate of a metallized substrate is made of a different material that has at least one layer of metal applied to at least one surface of the substrate. The material of the substrate of the metallized substrate can be any material for which a metal layer is capable of being applied. For instance, the substrate can be a synthetic material, such as a polymer. In various exemplary embodiments, a conductive substrate is, for example, at least one member selected from the group consisting of aluminum, aluminized or titanized polyethylene terephthalate belt (MYLAR®).

Any metal or metal alloy can be selected for the metal or metallized substrate. Typical metals employed for this purpose include aluminum, zirconium, niobium, tantalum, vanadium, hafnium, titanium, nickel, stainless steel, chromium, tungsten, molybdenum, mixtures and combinations thereof, and the like. Useful metal alloys may contain two or more metals such as zirconium, niobium, tantalum, vanadium, hafnium, titanium, nickel, stainless steel, chromium, tungsten, molybdenum, mixtures and combinations thereof, and the like. Aluminum, such as mirror-finish aluminum, is selected in embodiments for both the metal substrate and the metal in the metallized substrate. All types of substrates may be used, including honed substrates, anodized substrates, bohmite-coated substrates and mirror substrates.

A metal substrate or metallized substrate can be selected. Examples of substrate layers selected for the present imaging members include opaque or substantially transparent materials, and may comprise any suitable material having the requisite mechanical properties. Thus, for example, the substrate can comprise a layer of insulating material including inorganic or organic polymeric materials, such as Mylar®, a commercially available polymer, Mylar® containing titanium, a layer of an organic or inorganic material having a semiconductive surface layer, such as indium tin oxide or aluminum arrange thereon, or a conductive material such as aluminum, chromium, nickel, brass or the like. The substrate may be flexible, seamless, or rigid, and may have a number of different configurations. For example, the substrate may comprise a plate, a cylindrical drum, a scroll, and endless flexible belt, or other configuration. In some situations, it may be desirable to provide an anticurl layer to the back of the substrate, such as when the substrate is a flexible organic polymeric material, such as for example polycarbonate materials, for example Makrolon® a commercially available material.

In various exemplary embodiments, the photogenerator layer has any suitable thickness. In various exemplary embodiments, the photogenerator layer has a thickness of from about 0.05 micrometers to about 10 micrometers. In various exemplary embodiments, the transport layer has a thickness of from about 10 micrometers to about 50 micrometers. In various exemplary embodiments, the photogenerator layer includes photogenerating pigments dispersed in a resinous binder in an amount of from about 5 percent by weight to about 95 percent by weight. In various exemplary embodiments, the resinous binder is any suitable binder. In various exemplary embodiments, the resinous binder is at least one member selected from the group consisting of polyesters, polyvinyl butyrals, polycarbonates, polystyrene-b-polyvinyl pyridine, and polyvinyl formals.

The charge-transport component transports charge from the charge-generating layer to the surface of the photoreceptor. Often, the charge-transport component is made up of several materials, including electrically active organic-resin materials such as polymeric arylamine compounds, polysilylenes (such as poly(methylphenyl silylene), poly(methylphenyl silylene-co-dimethyl silylene), poly(cyclohexylmethyl silylene), and poly(cyanoethylmethyl silylene)), and polyvinyl pyrenes. The charge-transport component typically contains at least one compound having an arylamine, enamine, or hydrazone group. The compound containing the arylamine may be dispersed in a resinous binder, such as a polycarbonate or a polystyrene. In various exemplary embodiments, a charge transport layer can include aryl amine molecules. In various exemplary embodiments, a charge transport layer can include aryl amines of the following formula:

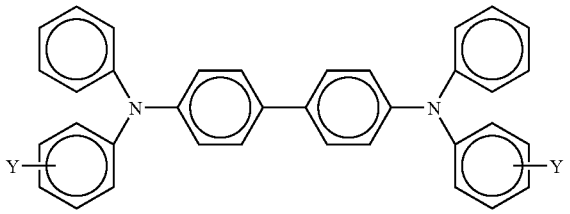

wherein Y is selected from the group consisting of alkyl and halogen, and wherein the aryl amine is dispersed in a highly insulating and transparent resinous binder. In embodiments, halogen is selected, such as for example fluorine, bromine, chlorine, and iodine. In various exemplary embodiments, the arylamine alkyl contains from about 1 to about 10 carbon atoms. In various exemplary embodiments, the arylamine alkyl contains from 1 to about 5 carbon atoms. In various exemplary embodiments, the arylamine alkyl is methyl, the halogen is chlorine, and the resinous binder is selected from the group consisting of polycarbonates and polystyrenes. A selected compound having an arylamine group is N,N'-diphenyl-N,N-bis(3-methyl phenyl)-1,1'-biphenyl-4,4'-diamine.

The charge-generating component converts light input into electron hole pairs. Examples of compounds suitable for use as the charge-generating component include vanadyl phthalocyanine, metal phthalocyanines (such as titanyl phthalocyanine, chlorogallium phthalocyanine, hydroxygallium phthalocyanine, and alkoxygallium phthalocyanine), metal-free phthalocyanines, benzimidazole perylene, amorphous selenium, trigonal selenium, selenium alloys (such as selenium-tellurium, selenium-tellurium arsenic, selenium arsenide), chlorogallium phthalocyanin, and mixtures and combinations thereof. In various exemplary embodiments, a photogenerating layer includes metal phthalocyanines and/or metal free phthalocyanines. In various exemplary embodiments, a photogenerating layer includes at least one phthalocyanine selected from the group consisting of titanyl phthalocyanines, perylenes, or hydroxygallium phthalocyanines. In various exemplary embodiments, a photogenerating layer includes Type V hydroxygallium phthalocyanine.

The additional layers containing the charge-transport component and the charge-generating component may be applied as a single layer or may be applied separately as two distinct layers. The decision of whether to apply the components as a single layer or separate layers lies within the preference of the skilled artisan. Traditionally, the components are applied as separate layers; however, applying the components as a single layer may prove more convenient, cheaper, and may result in an electrophotographic-imaging member that is thinner or contains other desirable properties. The additional layers, whether as a single layer or separate layers, may be applied by techniques known to those in the art, such as chemical vaporization, sputtering, spraying, dipping, and spin-and-roller coating.

The additional layer or layers containing the charge-transport and charge-generating components can include various other materials, such as binder polymeric resin materials, film-including particles, or resin layers having a photoconductive material. If the charge-transport component and charge-generating component are applied in separate layers, the layer containing the charge-generating component will typically contain the resinous binder composition. Suitable polymeric film-forming binder materials include, but are not limited to, thermoplastic and thermosetting resins, such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, amino resins, phenylene oxide resins, terephthalic acid resins, phenoxy resins, epoxy resins, phenolic resins, polystyrene and acrylonitrile copolymers, polyvinyl chloride, vinylchloride and vinyl acetate copolymers, acrylate copolymers, alkyd resins, cellulosic film formers, poly(amideimide), styrene-butadiene copolymers, vinylidinechloride-vinylchloride copolymers, vinylacetate-vinylidenechloride copolymers, vinylacetate-vinylidenechloride copolymers, styrene-alkyd resins, polyvinylcarbazole, and mixtures thereof.

The charge-generating component may also contain a photogenerating composition or pigment. The photogenerating composition or pigment may be present in the resinous binder composition in various amounts, ranging from about 5% by volume to about 90% by volume (the photogenerating pigment is dispersed in about 10% by volume to about 95% by volume of the resinous binder); or from about 20% by volume to about 30% by volume (the photogenerating pigment is dispersed in about 70% by volume to about 80% by volume of the resinous binder composition). In one embodiment, about 8 percent by volume of the photogenerating pigment is dispersed in about 92 percent by volume of the resinous binder composition. When the photogenerating component contains photoconductive compositions and/or pigments in the resinous binder material, the thickness of the layer typically ranges from about 0.1 μm to about 5.0 μm, or from about 0.3 μm to about 3 μm. The photogenerating layer thickness is often related to binder content, for example, higher binder content compositions typically require thicker layers for photogeneration. Thicknesses outside these ranges may also be selected.

The thickness of the device typically ranges from about 2 μm to about 100 μm; from about 5 μm to about 50 μm, or from about 10 μm to about 30 μm. The thickness of each layer will depend on how many components are contained in that layer, how much of each component is desired in the layer, and other factors familiar to those in the art. If the charge-generating component and charge-transport component are applied in separate layers, the ratio of the thickness of the layer containing the charge-transport component to the layer containing the charge-generating component typically ranges from about 2:1 to about 400:1, or from about 2:1 to about 200:1.

Various exemplary embodiments encompassed herein include a method of imaging which includes generating an electrostatic latent image on an imaging member, developing a latent image, and transferring the developed electrostatic image to a suitable substrate.

Further embodiments encompassed within the present disclosure include methods of imaging and printing with the photoresponsive devices illustrated herein. Various exemplary embodiments include methods including forming an electrostatic latent image on an imaging member; developing the image with a toner composition including, for example, at least one thermoplastic resin, at least one colorant, such as pigment, at least one charge additive, and at least one surface additive; transferring the image to a necessary member, such as, for example any suitable substrate, such as, for example, paper; and permanently affixing the image thereto. In various exemplary embodiments in which the embodiment is used in a printing mode, various exemplary imaging methods include forming an electrostatic latent image on an imaging member by use of a laser device or image bar; developing the image with a toner composition including, for example, at least one thermoplastic resin, at least one colorant, such as pigment, at least one charge additive, and at least one surface additive; transferring the image to a necessary member, such as, for example any suitable substrate, such as, for example, paper; and permanently affixing the image thereto.

EXAMPLES

The following Examples are being submitted to further define various species of the present disclosure. These Examples are intended to be illustrative only and are not intended to limit the scope of the present disclosure. Also, parts and percentages are by weight unless otherwise indicated.

Example I

An undercoat layer was prepared comprising 13.26 grams of titanium oxide (MT-150W available from Tayca Corporation), 4.4 grams phenolic resin (Varcuum 29159 available from Oxychem Corporation), and 6.5 grams melamine resin (Cymel® 323 available from Cytec Corporation) at a 63:37 pigment to binder weight ration and a 70:30 Varcuum to Cymel® 323 weight ratio. The undercoat layer was doped with 0.16 grams (0.8% by weight) ET259 near infrared dye available from Crystalyn Chemical Company. The undercoat layer was cured at 145° C. for 40 minutes. A 4 micrometers layer of the undercoat layer was disposed over an aluminum substrate. A photoreceptive imaging member was prepared by disposing a 0.2 to 0.5 micrometer thick charge generating comprising chlorogallium phthalocyanine and a vinyl resin binder at a pigment to binder weight ratio of about 60 to 40 and a 29 micrometer thick charge transport layer comprising N,N'-bis(methylphenyl)-1,1-biphenyl-4,4'-diamine, a polycarbonate binder, and PTFE particles as a weight ratio of 36.4 to 54.5 to 9.1, respectively.

Example II

An undercoat layer was prepared comprising 13.26 grams of titanium oxide (MT-150W available from Tayca Corporation), 4.4 grams phenolic resin (Varcuum 29159 available from Oxychem Corporation), and 6.5 grams melamine resin (Cymel® 323 available from Cytec Corporation) at a 63:37 pigment to binder weight ration and a 70:30 Varcuum to Cymel® 323 weight ratio. The undercoat layer was doped with 0.16 grams (0.8% by weight) ET457 near infrared dye available from Crystalyn Chemical Company. The undercoat layer was cured at 145° C. for 40 minutes. A 4 micrometers thick undercoat layer was disposed over an aluminum substrate. A photoreceptive imaging member was prepared by disposing a 0.2 to 0.5 micrometer thick charge generating comprising chlorogallium phthalocyanine and a vinyl resin binder at a pigment to binder weight ratio of about 60 to 40 and a 29 micrometer thick charge transport layer comprising N,N'-bis(methylphenyl)-1,1-biphenyl-4,4'-diamine, a polycarbonate binder, and PTFE particles as a weight ratio of 36.4 to 54.5 to 9.1, respectively.

Comparative Example I

An undercoat layer was prepared comprising 13.26 grams of titanium oxide (MT-150W available from Tayca Corporation), 4.4 grams phenolic resin (Varcuum 29159 available from Oxychem Corporation), and 6.5 grams melamine resin (Cymel® 323 available from Cytec Corporation) at a 63:37 pigment to binder weight ration and a 70:30 Varcuum to Cymel® 323 weight ratio. The undercoat layer was not doped with near infrared red absorbing dye. The undercoat layer was cured at 145° C. for 40 minutes. A 4 micrometer thick undercoat layer was disposed over an aluminum substrate. A photoreceptive imaging member was prepared by disposing a 0.2 to 0.5 micrometer thick charge generating comprising chlorogallium phthalocyanine and a vinyl resin binder at a pigment to binder weight ratio of about 60 to 40 and a 29 micrometer thick charge transport layer comprising N,N'-bis(methylphenyl)-1,1-biphenyl-4,4'-diamine, a polycarbonate binder and PTFE particles as a weight ratio of 36.4 to 54.5 to 9.1, respectively.

The devices were acclimated for 24 hours before testing in J zone (70° F., 10% relative humidity). Print samples were prepared for each device on a Copeland Work Center Pro 3545 device using black and white copy mode and a machine speed of 208 mm. Ghosting levels were measured against an image standard of ghosting grades from 0-5. The printing protocol comprised 1) printing ghost target at the start of test (t=0); 2) printing 200 documents using a 5% area coverage; 3) printing ghost target after 200 documents; and 4) visually evaluating the printed documents comparing to the image standard. Test results are provided in Table 1.

TABLE 1

| Example Number | Zone | Ghost T = 0 | Ghost T = 200 |
|---|---|---|---|
| 1 | J | −2 | −3 |
| 2 | J | −2 | −3.5 |
| Comparative Example 1 | J | −3 | −5 |

It will be appreciated that various of the above-discussed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. An imaging member comprising:

a metal or metallized substrate;

an undercoat layer comprising a polymer resin and a near infrared absorbing component having a molar extinction coefficient of greater than about 100,000 at an imaging member exposure wavelength of from about 750 to about 900 nanometers; and one or more additional layers disposed on the undercoat layer, wherein the additional layer or layers comprise a charge-generating component and a charge-transport component;

wherein the near infrared absorbing component comprises a material having the structure (1)

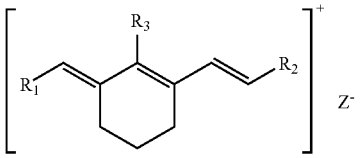

wherein $R_1$, $R_2$, and $R_3$ are the same or different and are selected separately from hydrocarbon having from about 1 to about 30 carbons, alky, alkenyl, alkynyl, aryl, and heterocyclic substituents; and wherein Z is selected from the group consisting of

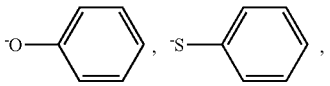

and $X^-$, wherein $X^-$ is selected from the group consisting of Br, Cl, $ClO_4$, and $BF_4$.

2. The imaging member of claim 1, wherein the near infrared absorbing component absorbs at an exposure wavelength of from about 750 to about 800 nanometers.

3. The imaging member of claim 1, wherein the near infrared absorbing component absorbs at an exposure wavelength of about 780 nanometers.

4. The imaging member of claim 1, wherein the near infrared absorbing component is selected in an amount of from about 0.01 to about 20 percent by weight based upon the total weight of the undercoat layer.

5. The imaging member of claim 1, wherein the near infrared absorbing component is selected in an amount of from about 0.1 to about 5 percent by weight based upon the total weight of the undercoat layer.

6. The imaging member of claim 1, wherein the near infrared absorbing component comprises a dye selected from the group consisting of squaraines, aryldienes, aryltrienes, and metal dithiolene.

7. The imaging member of claim 1, wherein the near infrared absorbing component comprises a material having the structure

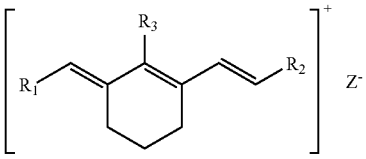

wherein $R_1$ is

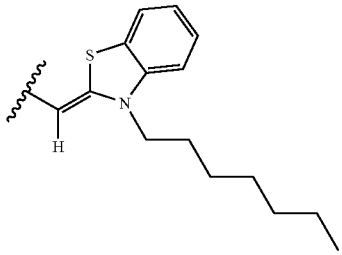

$R_2$ is

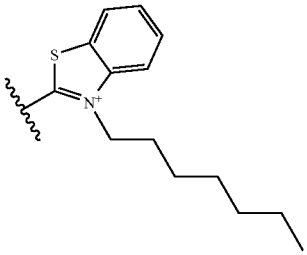

$R_3$ is selected from

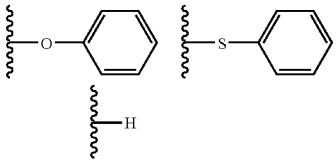

and and

Z is selected from

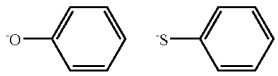

and $X^-$ wherein $X^-$ is selected from the group consisting of Br, Cl, $ClO_4$, and $BF_4$.

8. The imaging member of claim 1, wherein the polymer resin comprises at least one resin selected from the group consisting of polyethylenes, polypropylenes, polystyrenes, acrylic resins, vinyl chloride resins, vinyl acetate resins, polyurethanes, epoxy resins, polyesters, melamine resins, silicone resins, polyvinyl butyryls, polyamides, phenolic resins, copolymers thereof, and mixtures thereof.

9. The imaging member of claim 1, wherein the polymer resin further comprises at least one additional material selected from the group consisting of caseins, gelatins, polyvinyl alcohols, ethyl celluloses and mixtures thereof.

10. The imaging member of claim 1, wherein the undercoat layer further comprises titanium dioxide.

11. The method of claim 1, wherein the undercoat layer further comprises a titanium dioxide in a phenolic resin/melamine resin.

12. The imaging member of claim 1, wherein the undercoat layer has a thickness of from about 0.1 micrometers to about 100 micrometers.

13. The imaging member of claim 1, wherein the charge-transport component comprises at least one compound having an arylamine group, an enamine group, a hydrazone group, or a combination thereof.

14. The imaging member of claim 1, wherein the charge-generating component comprises a material selected from the group consisting of vanadyl phthalocyanine, metal phthalocyanines, metal-free phthalocyanine, hydroxygallium phthalocyanine, benzimidazole perylene, amorphous selenium, trigonal selenium, selenium alloys, chlorogallium phthalocyanin, mixtures thereof, and combinations thereof.

15. The imaging member of claim 1, wherein the metal or metallized substrate comprises aluminum, zirconium, niobium, tantalum, vanadium, hafnium, titanium, nickel, stainless steel, chromium, tungsten, molybdenum, metal alloys comprising two or more metals selected from the group comprising zirconium, niobium, tantalum, vanadium and hafnium, titanium, nickel, stainless steel, chromium, tungsten, molybdenum, mixtures thereof, and combinations thereof.

16. The method of claim 1, wherein the metal or metallized substrate comprises aluminum.

17. An imaging member comprising:

a metal or metallized substrate;

an undercoat layer comprising a polymer resin and a near infrared absorbing dye having a molar extinction coefficient of greater than about 100,000 at an imaging member exposure wavelength of from about 750 to about 900 nanometers, and is soluble in an undercoat layer solvent;

wherein the near infrared absorbing component comprises a material having the structure (1)

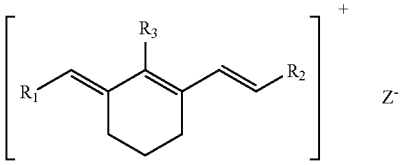

wherein $R_1$, $R_2$, and $R_3$ are the same or different and are selected separately from hydrocarbon having from about 1 to about 30 carbons, alky, alkenyl, alkynyl, aryl, and heterocyclic substituents; and wherein Z is selected from the group consisting of

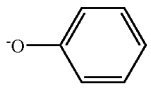

,

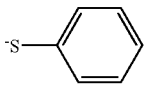

, and $X^-$, wherein $X^-$ is selected from the group consisting of Br, Cl, $ClO_4$, and $BF_4$; and one or more additional layers disposed on the undercoat layer, wherein the additional layer or layers comprise a charge-generating component and a charge-transport component.

18. An image forming apparatus for forming images on a recording medium comprising:

a) a photoreceptor member having a charge retentive surface to receive an electrostatic latent image thereon, wherein said photoreceptor member comprises a conductive substrate, an undercoat layer comprising a polymer resin and a near infrared region absorbing component having a molar extinction coefficient of greater than about 100,000 at an imaging member exposure wavelength of from about 750 to about 900 nanometers, wherein the near infrared absorbing component is soluble in an undercoat layer solvent, wherein the near infrared absorbing component comprises a material having the structure (1)

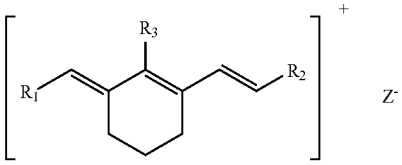

wherein $R_1$, $R_2$, and $R_3$ are the same or different and are selected separately from hydrocarbon having from about 1 to about 30 carbons, alky, alkenyl, alkynyl, aryl, and heterocyclic substituents; and wherein Z is selected from the group consisting of

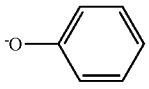

,

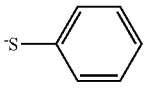

, and $X^-$, wherein $X^-$ is selected from the group consisting of Br, Cl, $ClO_4$, and $BF_4$; a charge-generating layer, and a charge transport layer comprising charge transport materials dispersed therein;

b) a development component to apply a developer material to said charge-retentive surface to develop said electrostatic latent image to form a developed image on said charge-retentive surface;

c) a transfer component for transferring said developed image from said charge-retentive surface to another member or a copy substrate; and d) a fusing member to fuse said developed image to said copy substrate.

* * * * *